US006272862B1

(12) United States Patent
Handley et al.

(10) Patent No.: US 6,272,862 B1
(45) Date of Patent: Aug. 14, 2001

(54) RETENTION OF A GLAND WITHIN AN ACTUATOR

(75) Inventors: Kevin J. Handley, Stafford; John H. Harvey, Wolverhampton, both of (GB)

(73) Assignee: Lucas Industries plc (GB)

( * ) Notice: Subject to any disclaimer, the term of this patent is extended or adjusted under 35 U.S.C. 154(b) by 0 days.

(21) Appl. No.: 09/536,031

(22) Filed: Mar. 27, 2000

(30) Foreign Application Priority Data

Mar. 31, 1999 (GB) ..... 9907328

(51) Int. Cl.[7] ..... F01B 31/00
(52) U.S. Cl. ..... 60/696; 92/169.1; 92/151
(58) Field of Search ..... 60/696; 92/169.1, 92/150, 151

(56) References Cited

U.S. PATENT DOCUMENTS

| | | | | |
|---|---|---|---|---|
| 3,253,519 | * | 5/1966 | Roo | 92/151 X |
| 3,474,710 | | 10/1969 | Stryker . | |
| 3,968,735 | * | 7/1976 | Boisde et al. | 92/151 X |
| 4,205,594 | * | 6/1980 | Burke | 92/151 X |
| 4,496,071 | | 1/1985 | Stewart . | |
| 4,697,499 | * | 10/1987 | Dirkin et al. | 92/151 |
| 6,047,788 | * | 4/2000 | Bohner et al. | 92/151 X |

FOREIGN PATENT DOCUMENTS

| | | | | |
|---|---|---|---|---|
| 606819 | * | 4/1977 | (CH) | 92/151 |
| 21 58 720 | | 5/1973 | (DE) . | |
| 38 31 909 | | 3/1990 | (DE) . | |
| 298 14 578 | | 10/1998 | (DE) . | |
| 0 348 687 | | 1/1990 | (EP) . | |
| 0 662 568 | | 7/1995 | (EP) . | |

* cited by examiner

*Primary Examiner*—Hoang Nguyen
(74) *Attorney, Agent, or Firm*—Andrus, Sceales, Starke & Sawall

(57) ABSTRACT

An actuator having a body defining an internal cavity and a gland disposed within the cavity, the gland being secured against movement relative to the actuator body in a direction along the internal cavity by a securing element located in an opening of which respective parts are defined by the actuator body and the gland, and which allows insertion of the securing element into the opening along a substantially linear path.

18 Claims, 3 Drawing Sheets

FIG 2
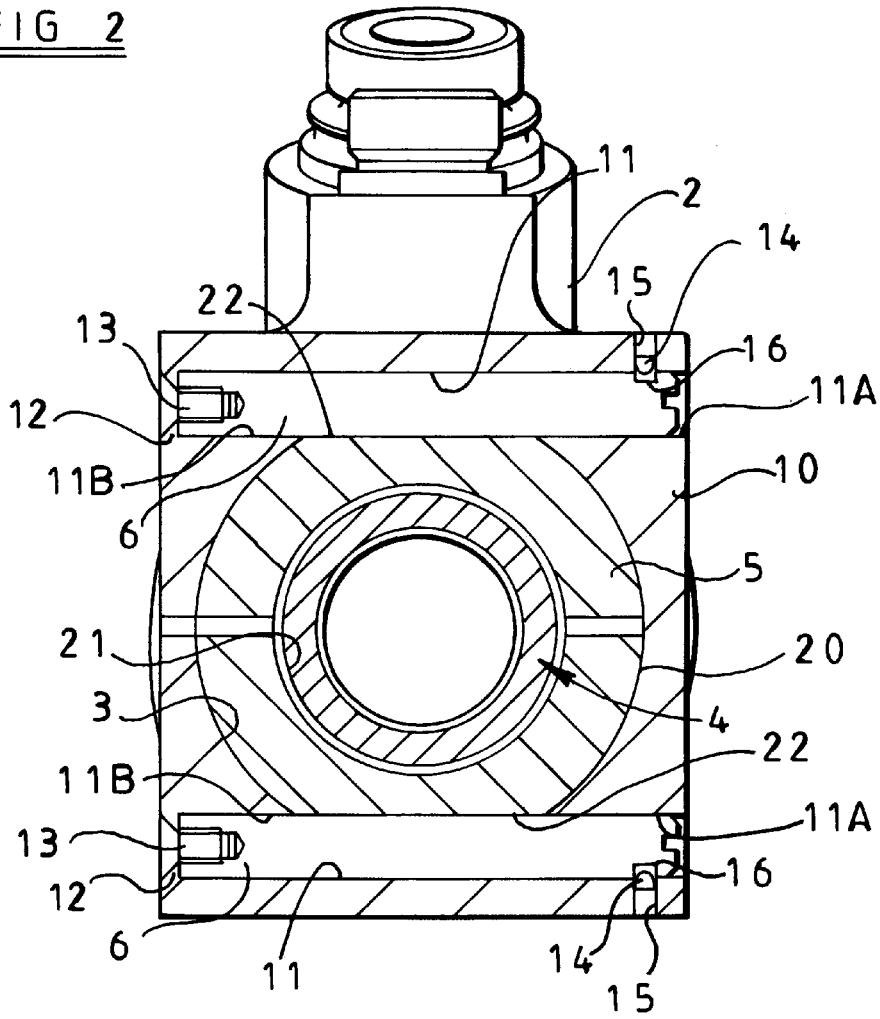
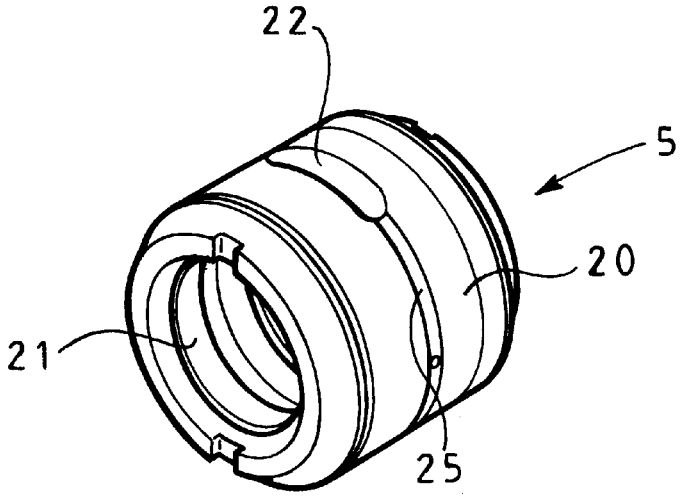
FIG 3

FIG 4
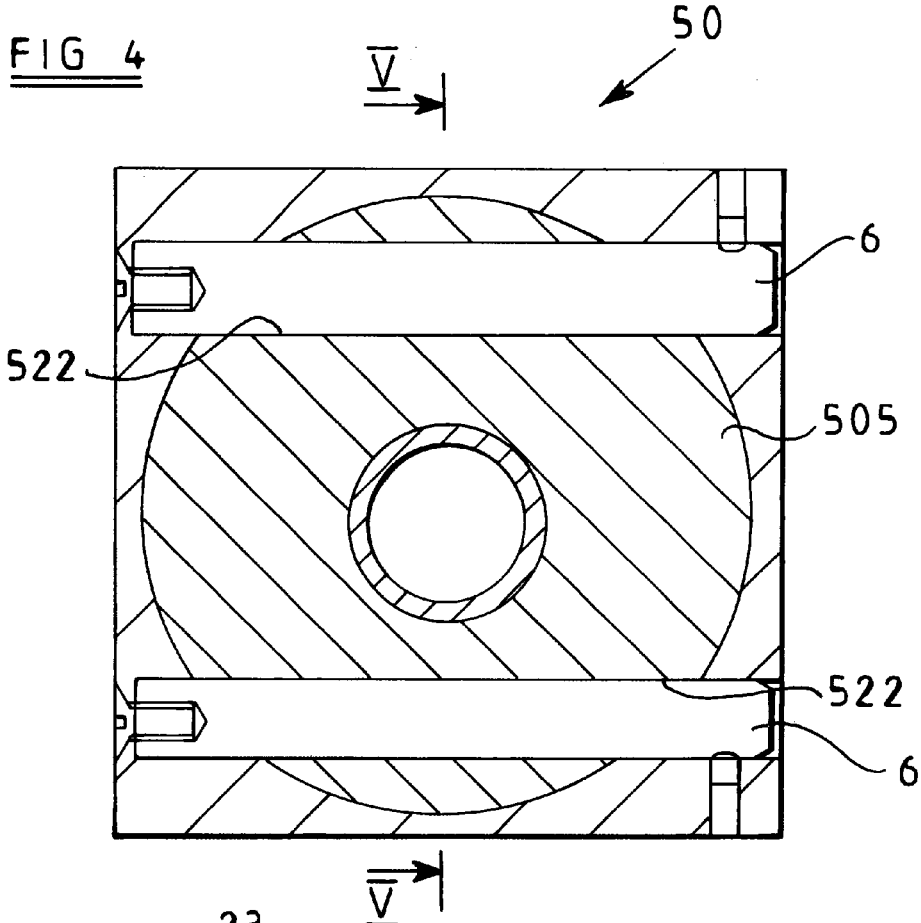
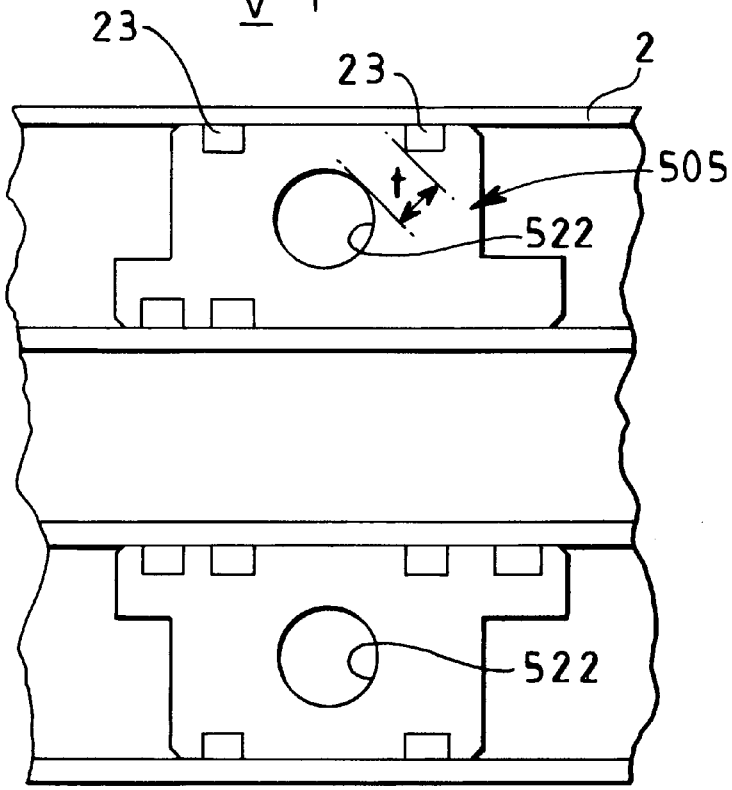
FIG 5

RETENTION OF A GLAND WITHIN AN ACTUATOR

This invention relates to the retention of a gland within the body of an actuator, for example an hydraulic actuator for use in aerospace applications.

In a known type of hydraulic actuator, a gland is mounted about an actuator rod that extends through a cavity defined by the actuator body, the gland forming a fluid-tight partition dividing the cavity into two chambers which, typically, in use, contain hydraulic fluid under pressure. The known gland is retained axially in position within the actuator body by a wire ring located in a passageway formed by opposed grooves extending circumferentially respectively around the outer periphery of the gland and an inner surface of the actuator body defining the cavity.

However, a clearance must be provided between the wire ring and the surfaces defining the circumferentially extending grooves to allow the wire ring to be fed into the grooves during assembly of the actuator. This can result in an undesirable degree of play in the wire ring when located in the grooves leading to possible fretting fatigue problems during the life of the unit. Moreover the space envelope required by the cylinder to accommodate the wire ring necessitates an increase in cylinder diameter around its entire circumference, which can be undesirable for some aerospace applications.

An actuator is provided in accordance with the invention comprising a body defining an internal cavity and a gland disposed within the cavity, the gland being secured against movement relative to the actuator body in a direction along the internal cavity by a securing element located in an opening of which respective parts are defined by the actuator body and the gland, and which allows insertion of the securing element into the opening along a substantially linear path.

In one convenient arrangement, the opening part in the actuator body is formed by a hole and the opening part in the gland is a groove in the outer periphery thereof aligned with the hole, the securing element extending through the hole and lying along the groove.

Alternatively the opening part in the gland is a hole extending through the gland in alignment with the hole in the body, the securing element extending through at least a part of both of the holes.

Conveniently the securing element is locked in position by fastening devices extending axially and/or transversely of the securing element.

The securing element may be configured and arranged to provide in the opening a vent passage extending between the outer peripheral surface of the gland and the body exterior by way of the opening part in the body.

In order that the invention may be well understood, two embodiments thereof, which are given by way of example only, will now be described with reference to the accompanying drawings, in which:

FIG. 2 shows a sectional view along the line (II—II) in FIG. 1;

FIG. 3 shows a perspective view of the gland shown in FIGS. 1 and 2;

FIG. 4 is a sectional view, corresponding to the sectional view in FIG. 2, of another of the actuator; and FIG. 5 is a sectional view along the line (V—V) in FIG. 4.

Figure 1:
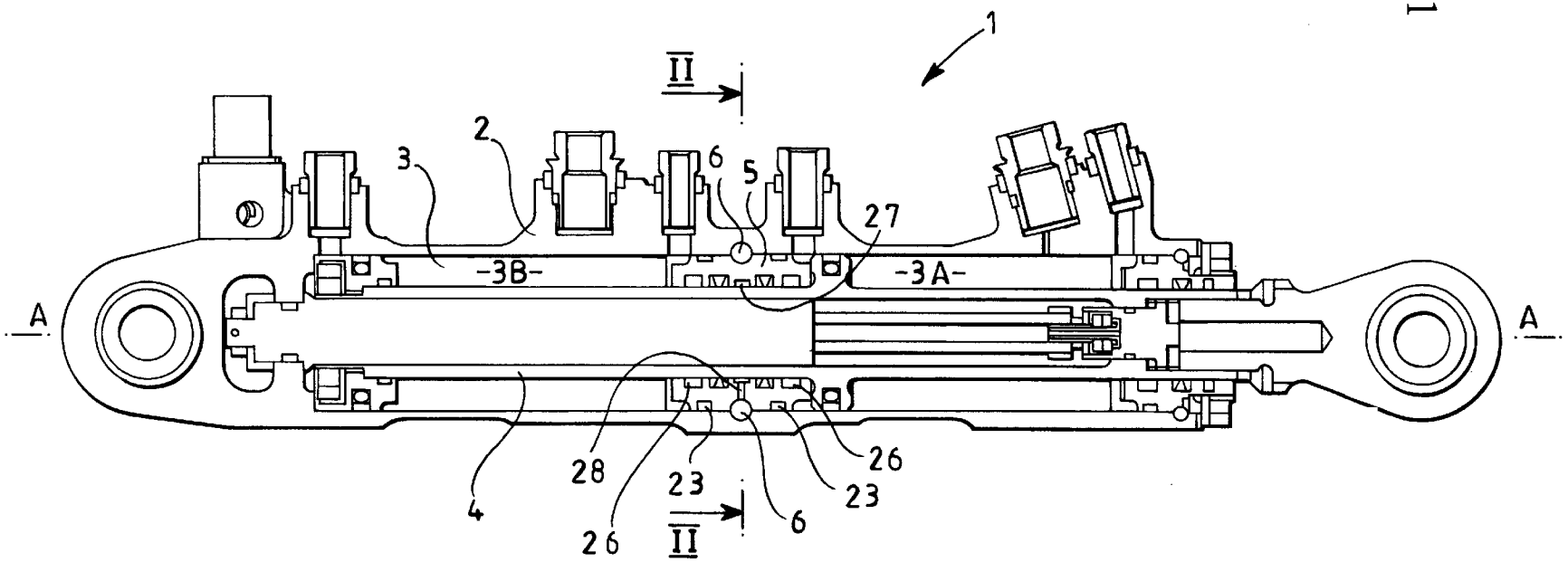
FIG. 1 shows a first embodiment of the invention in the form of an hydraulic actuator containing a gland retained in place within the actuator body.

The actuator 1 in FIG. 1 has a hollow body 2 defining a cavity 3 through which extends an actuator rod 4. The actuator rod 4 is of a known type and is slidably mounted within the actuator body 2 in a known manner. A gland 5 is fitted within the body 2 so as to form a fluid-tight partition dividing the cavity 3 into two chambers 3A and 3B. The rod 4 divides each chamber into separate portions that can be connected to a variety of fluid pressure sources for controlling the position of the rod within the actuator body 2. This aspect of the actuator 1 is known and will not be described in further detail. The gland 5 is secured in position within the actuator body 2 against the action of a pressure differential between chambers 3A and 3B by means of two securing elements, shown as pins 6. The pins 6 are made of metal, but may alternatively be made of another sufficiently strong and rigid material. FIG. 2 shows a partial cross-section through the actuator 1 viewed along the line (II—II) in FIG. 1. The actuator body 2 is provided with a transversely extending rectangular flange 10 containing transversely and substantially linearly extending upper and lower bores 11 in which the securing pins 6 are received. One end portion 11A of each of the bores 11 (the right hand end portion in FIG. 2) provides a through-hole in the actuator body 2 communicating with the cavity 3 and the outside of the actuator body 2. The opposite end portion 11B of each of the bores 11 (the left hand end portion in FIG. 2) opens into the cavity 3 and is closed at its distal end by an end wall 12. The securing pins 6 are inserted respectively in the open end portions 11A of the bores 11 and the respective leading end portions of the pins 6 are held in place in the opposite end portions 11B of the respective bores 11 by screws 13 which engage threaded bores extending axially within the leading end portions of the pins 6. A head of each screw 13 abuts a recessed outer surface of a respective one of the walls 12.

The opposite end of each pin 6 (the right hand end in FIG. 2) is secured in location in its respective bore 11 by secondary retention means in the form of a pin or plug 14. The pin or plug 14 is received partly in a secondary passage 15 extending from the bore 11 to the outside of the actuator body 2 and partly in a recess 16 in the securing pin 6. The secondary bore 15 and the recess 16 both extend perpendicularly to the bore 11 in mutual alignment. The pin or plug 14 restricts movement of the securing pin 6 in the direction of its own axis.

The gland 5 has a substantially circular outer peripheral surface 20 engaging an inner peripheral surface of the body 2, and a substantially circular inner peripheral surface 21 for slidably receiving the actuator rod 4. The outer and inner peripheral surfaces 20, 21 are concentrically arranged as shown in FIG. 3. Mutually parallel linearly and transversely extending grooves 22 are formed on opposite sides of the gland 5, being the top and bottom sides as seen in FIG. 2. With the gland fitted inside the chamber 3 of the actuator body 2 the grooves 22 are aligned with respective ones of the bores 11 so that each groove and bore jointly form a respective opening in the form of a passageway in which the securing pins 6 are tightly fitted. The securing pins 6 thereby prevent movement of the gland 5 in the direction of the longitudinal axis of the actuator 1. The pins 6, bores 11, and grooves 22 can be tightly toleranced, for example to within ±0.025 mm, for accurate location and secure retention of the gland within the actuator body 2.

During assembly of the actuator 1, the gland 5 is fitted into chamber 3 and its grooves 22 aligned with the respective bores 11 to form the resulting passageways. Securing pins 6 are inserted into respective passageways 11,22 and secured in place in the body 2 by the screws 13. The secondary retaining pins or plugs 14 are then located in their respective recesses 16 and bores 15. The gland 5 can be readily removed for replacement or repair by reversing these assembly steps.

Each groove 22 is disposed centrally between the axial ends of the gland 5. Seals 23 are disposed to either side axially of the groove 22 for preventing egress of fluid from chambers 3A, 3B along the interface between the outer peripheral surface 20 of the gland 5 and the inner peripheral surface of the actuator body 2. Each securing pin 6 has a flat face (not shown) extending along its entire length and is angularly orientated with respect to its longitudinal axis such that its flat face, together with the inner peripheral surface of a respective passageway 11, 22 defines a vent passage providing fluid communication between the groove 22 and the exterior of the actuator 1 via the open ends 11A of the passageways. Fluid leaking under pressure from one of the chambers 3A, 3B and reaching the groove 22 will thus be allowed to seep through the vent passage to atmosphere. In the embodiment of FIGS. 1–3, the provision of each flat face reduces the diameter of its pin 6 by the order of about 0.5 mm.

To further discourage fluid from leaking from one of the chambers 3A, 3B into the other, a respective auxiliary groove 25 extends from one end of each of the grooves 22 around the outer periphery of the gland 5 to a corresponding end of the other of the grooves 22. Fluid migrating past one of the seals 23 along the interface between the outer peripheral surface 20 of the gland 5 and the inner peripheral surface of the actuator body 2 will be caught by the auxiliary grooves 25 and directed into the grooves 22. The leaked fluid can then seep from the grooves 22 to atmosphere through the respective vent passages as described above.

Seals 26 are provided on the inner periphery of the gland 5 to prevent migration of fluid between the chambers 3A, 3B along the interface between the engaging peripheral surfaces of the gland 5 and the actuator rod 4. Any fluid which does penetrate past one of the seals 26 is received in a groove 27 in the inner peripheral surface of the gland 5 which feeds to a bore 28 interconnecting the groove 27 and the lower one of the grooves 22. The leaked fluid can thus be allowed to seep to atmosphere through the vent passage of the lower groove 22.

FIGS. 4 and 5 show portions of a further actuator 50 embodying the invention. Actuator 50 is substantially identical to actuator 1 except that, instead of the grooves 22, the gland 505 of actuator 50 has mutually parallel, linearly and transversely extending through-holes 522 for receiving the securing pins 6.

By providing through-holes 522 in the glands 505 it is possible to provide a gland which is shorter in the direction of its longitudinal axis. This is because it is essential to maintain a predetermined minimum thickness of gland material between the groove 22 or through-hole 522 and the outer peripheral recesses in the gland which house the seals 23. As best shown in FIG. 5, the thickness 't' of material between the hole 522 and seal 23 becomes greater the further the hole is located towards the inner peripheral surface of the gland 505. In the case where the groove 22 is located on the outer peripheral surface 20 of the gland 505 the thickness 't' is a minimum, so that a longer gland 505 will be required to maintain a predetermined minimum thickness t. The transverse dimensions of the actuator in a direction along the pins and in a direction perpendicular thereto can both be reduced using a construction similar to that shown in FIGS. 4 and 5.

The embodiment of FIGS. 4 and 5 facilitates the provision of a smaller gland 505 which is lighter and cheaper to produce whilst providing an actuator 50 having similar advantages to the actuator 1 of FIGS. 1 to 3.

What we claim is:

1. An actuator comprising a body defining an internal cavity and a gland disposed within the cavity, the gland being secured against movement relative to the actuator body in a direction along the internal cavity by a securing element located in an opening of which respective parts are defined by the actuator body and the gland, and which allows insertion of the securing element into the opening along a substantially linear path, wherein the securing element is locked in position by fastening devices extending axially and/or transversely of the securing element.

2. An actuator as claimed in claim 1, wherein the opening part in the actuator body is formed by a hole and the opening part in the gland is a groove in the outer periphery thereof aligned with the hole, the securing element extending through the hole and lying along the groove.

3. An actuator as claimed in claim 1, wherein the opening part in the gland is a hole extending through the gland in alignment with the hole in the body, the securing element extending through at least a part of both of the holes.

4. An actuator as claimed in claim 1, wherein the securing element is configured and arranged to provide in the opening a vent passage extending between the outer periphery of the gland and the body exterior by way of the opening part in the body.

5. An actuator as claimed in claim 4, wherein the securing element is provided with a flat face which forms a wall of the vent passage when the securing element is inserted in a said opening having a substantially circular configuration.

6. An actuator as claimed in claim 1, wherein said opening part in the gland is interconnected for fluid communication with an auxiliary groove in the gland's outer periphery.

7. An actuator as claimed in claim 1, having more than one said opening, each opening allowing insertion therein of a respective said securing element.

8. An actuator comprising a body defining an internal cavity and a gland disposed within the cavity, the gland being secured against movement relative to the actuator body in a direction along the internal cavity by a securing element located in an opening of which respective parts are defined by the actuator body and the gland, and which allows insertion of the securing element into the opening along a substantially linear path, wherein the opening part in the actuator body is formed by a hole and the opening part in the gland is a groove in the outer periphery thereof aligned with the hole, the securing element extending through the hole and lying along the groove, the securing element configured and arranged to provide in the opening a vent passage extending between the outer periphery of the gland and the body exterior by way of the opening part in the body.

9. An actuator as claimed in claim 8, wherein the opening part in the gland is a hole extending through the gland in alignment with the hole in the body, the securing element extending through at least a part of both of the holes.

10. An actuator as claimed in claim 8, wherein the securing element is provided with a flat face which forms a wall of the vent passage when the securing element is inserted in a said opening having a substantially circular configuration.

11. An actuator as claimed in claim 8, wherein said opening part in the gland is interconnected for fluid communication with an auxiliary groove in the gland's outer periphery.

12. An actuator as claimed in claim 8, having more than one said opening, each opening allowing insertion therein of a respective said securing element.

13. An actuator comprising a body defining an internal cavity and a gland disposed within the cavity, the gland being secured against movement relative to the actuator body in a direction along the internal cavity by a securing element located in the opening of which respective parts are defined by the actuator body and the gland, and which allows insertion of the securing element into the opening along a substantially linear path, wherein the securing element is configured and arranged to provide in the opening a vent passage extending between the outer periphery of the gland and the body exterior by way of the opening part in the body.

14. An actuator as claimed in claim 13, wherein the opening part in the gland is a hole extending through the gland in alignment with the hole in the body, the securing element extending through at least a part of both of the holes.

15. An actuator as claimed in claim 14, wherein the securing element is provided with a flat face which forms a wall of the vent passage when the securing element is inserted in a said opening having a substantially circular configuration.

16. An actuator as claimed in claim 14, wherein said opening part in the gland is interconnected for fluid communication with an auxiliary groove in the gland's outer periphery.

17. An actuator as claimed in claim 14, having more than one said opening, each opening allowing insertion therein of a respective said securing element.

18. An actuator comprising a body defining an internal cavity and a gland disposed within the cavity, the gland being secured against movement relative to the actuator body in a direction along the internal cavity by a securing element located in an opening of which respective parts are defined by the actuator body and the gland, and which allows insertion of the securing element into the opening along a substantially linear path, wherein said opening part in the gland is interconnected for fluid communication with an auxiliary groove in the outer periphery of the gland.

* * * * *

UNITED STATES PATENT AND TRADEMARK OFFICE

CERTIFICATE OF CORRECTION

PATENT NO. : 6,272,862 B1
DATED : August 14, 2001
INVENTOR(S) : Kevin J. Handley et al.

It is certified that error appears in the above-identified patent and that said Letters Patent is hereby corrected as shown below:

Column 5, claim 15,
Line 17, delete "14" and substitute -- 13 --.

Column 6, claim 16,
Line 1, delete "14" and substitute -- 13 --.

Column 6, claim 17,
Line 5, delete "14" and substitute -- 13 --.

Signed and Sealed this

Nineteenth Day of March, 2002

*Attest:*

*Attesting Officer*

JAMES E. ROGAN
*Director of the United States Patent and Trademark Office*